US007264466B2

(12) United States Patent
Miller et al.

(10) Patent No.: US 7,264,466 B2
(45) Date of Patent: Sep. 4, 2007

(54) METHOD AND APPARATUS FOR RADIANT TUBE COMBUSTION

(75) Inventors: Todd A. Miller, Garfield Heights, OH (US); Dennis E. Quinn, Hinckley, OH (US); Thomas F. Robertson, Medina Township, OH (US)

(73) Assignee: North American Manufacturing Company, Cleveland, OH (US)

( * ) Notice: Subject to any disclaimer, the term of this patent is extended or adjusted under 35 U.S.C. 154(b) by 236 days.

(21) Appl. No.: 10/939,094

(22) Filed: Sep. 10, 2004

(65) Prior Publication Data

US 2006/0057516 A1 Mar. 16, 2006

(51) Int. Cl.
*F23C 5/00* (2006.01)
*F23M 3/00* (2006.01)

(52) U.S. Cl. ..... 431/8; 431/9; 431/10; 431/116

(58) Field of Classification Search ..... 431/8, 431/9, 10, 115, 116; 110/204, 205
See application file for complete search history.

(56) References Cited

U.S. PATENT DOCUMENTS 2,059,523 A 11/1936 Hepburn et al.
2,167,183 A 7/1939 Naab et al.
3,990,831 A 11/1976 Syska
4,240,784 A 12/1980 Dauvergne
4,445,842 A 5/1984 Syska
4,629,413 A * 12/1986 Michelson et al. ..... 431/9
4,800,866 A 1/1989 Finke
4,828,483 A 5/1989 Finke
4,983,118 A 1/1991 Hovis et al.
5,129,818 A 7/1992 Balsiger
5,269,679 A 12/1993 Syska et al.
5,368,472 A 11/1994 Hovis et al.
5,775,317 A 7/1998 Finke
6,029,647 A 2/2000 Pisano et al.
6,190,159 B1 * 2/2001 Moore et al. ..... 431/11
6,663,380 B2 * 12/2003 Rabovitser et al. ..... 431/9

OTHER PUBLICATIONS

Undated drawing of prior art North American Manufacturing Co. apparatus entitled: "Direct Fired Homogenizer Burner."
International Search Report of Application No. PCT/US05/32077, date of mailing Sep. 11, 2006-8 pgs.

* cited by examiner

*Primary Examiner*—Alfred Basichas
(74) *Attorney, Agent, or Firm*—Jones Day

(57) ABSTRACT

A method and apparatus provide combustion in a radiant tube in first, second and third stages, with flue gas recirculation that begins at the second stage.

6 Claims, 2 Drawing Sheets

METHOD AND APPARATUS FOR RADIANT TUBE COMBUSTION

TECHNICAL FIELD

This technology relates to a radiant tube for heating a process chamber in a furnace.

BACKGROUND

A radiant tube is a device that is used to heat a process chamber in a furnace. The process chamber is heated by thermal energy that radiates from the tube as a result of combustion that occurs within the tube. A combustible mixture of reactants is directed into one end of the tube, and combustion proceeds downstream through a combustion zone that extends along the length of the tube toward a flue at the opposite end of the tube.

SUMMARY

A method and apparatus provide combustion in a radiant tube in first, second and third stages, with flue gas recirculation that begins at the second stage.

The method includes forming a first reactant stream which contains fuel and combustion air, and which is free of gas recirculated from the flue end of the radiant tube. The first reactant stream is directed into the tube to provide a first combustion stage. Second and third reactant streams are formed to contain combustion air and gas recirculated from the flue end portion of the tube. The second reactant stream is directed into the tube separately from the first reactant stream to provide a second combustion stage. The third reactant stream is directed into the tube to provide a third combustion stage at a location downstream of the location at which the second reactant stream is directed into the tube.

The apparatus includes a staging structure that defines first, second and third stage reactant inlets at upstream ends of respective first, second and third stage regions of the combustion zone within the radiant tube. The staging structure communicates the first reactant inlet with streams of fuel and combustion air to the exclusion of a stream of recirculated flue gas, and communicates the second and third reactant inlets with streams of combustion air and recirculated flue gas to the exclusion of the stream of fuel.

Summarized differently, the staging structure includes a primary reactant tube having an open end configured as a first stage reactant inlet to the combustion zone. The primary reactant tube extends within the radiant tube to define an annular space radially between the primary reactant tube and the surrounding radiant tube. The annular space is a mixing chamber for combustion air and recirculated flue gas. A baffle portion of the staging structure is interposed between the mixing chamber and the combustion zone. The baffle defines a second stage reactant inlet that communicates the mixing chamber with the combustion zone, and defines a third stage reactant inlet that communicates the mixing chamber with the combustion zone at a location downstream of the second stage reactant inlet.

DESCRIPTION

Figure 1:
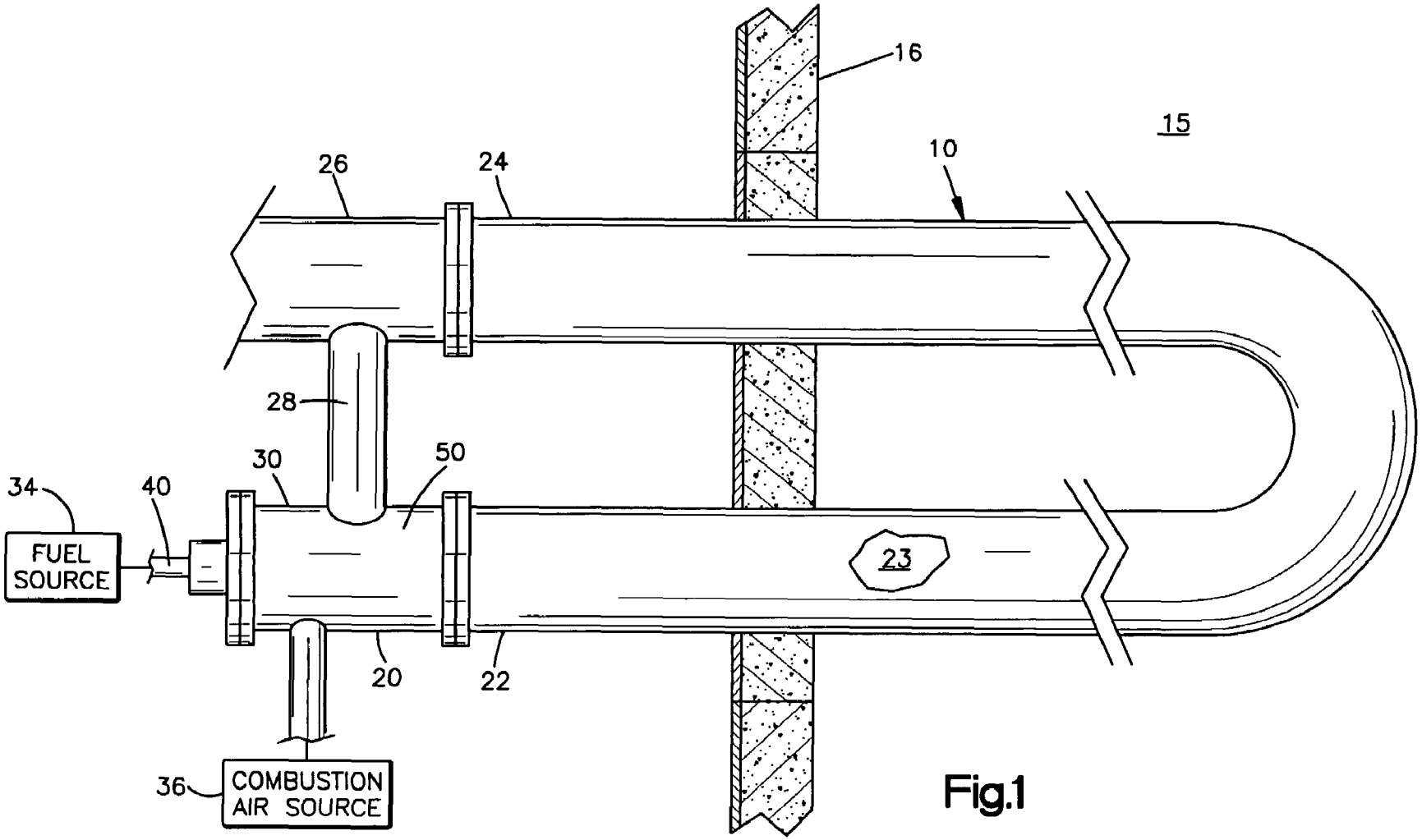
FIG. 1 is a side view of an apparatus including a radiant tube in a furnace.

The apparatus shown in FIG. 1 has parts that are examples of the elements recited in the claims. These include a radiant tube 10 for heating a process chamber 15 in a furnace. The radiant tube 10 is mounted on a furnace wall 16, and has a U-shaped configuration extending from the furnace wall 16 into the process chamber 15.

A burner assembly 20 delivers reactants to a burner end portion 22 of the radiant tube 10. Combustion for heating the process chamber 15 proceeds downstream through a combustion zone 23 that extends lengthwise within the tube 10 from the burner end portion 22 toward a flue end portion 24. A flue pipe 26 extends from the flue end portion 24, and a recirculation pipe 28 diverts some of the flue gases from the flue pipe 26 to the burner assembly 20. As described below, the burner assembly 20 is configured as a staging structure to provide staged combustion with flue gas recirculation in the radiant tube 10. This helps to minimize the amount of NOx discharged from the flue pipe 26.

Figure 2:
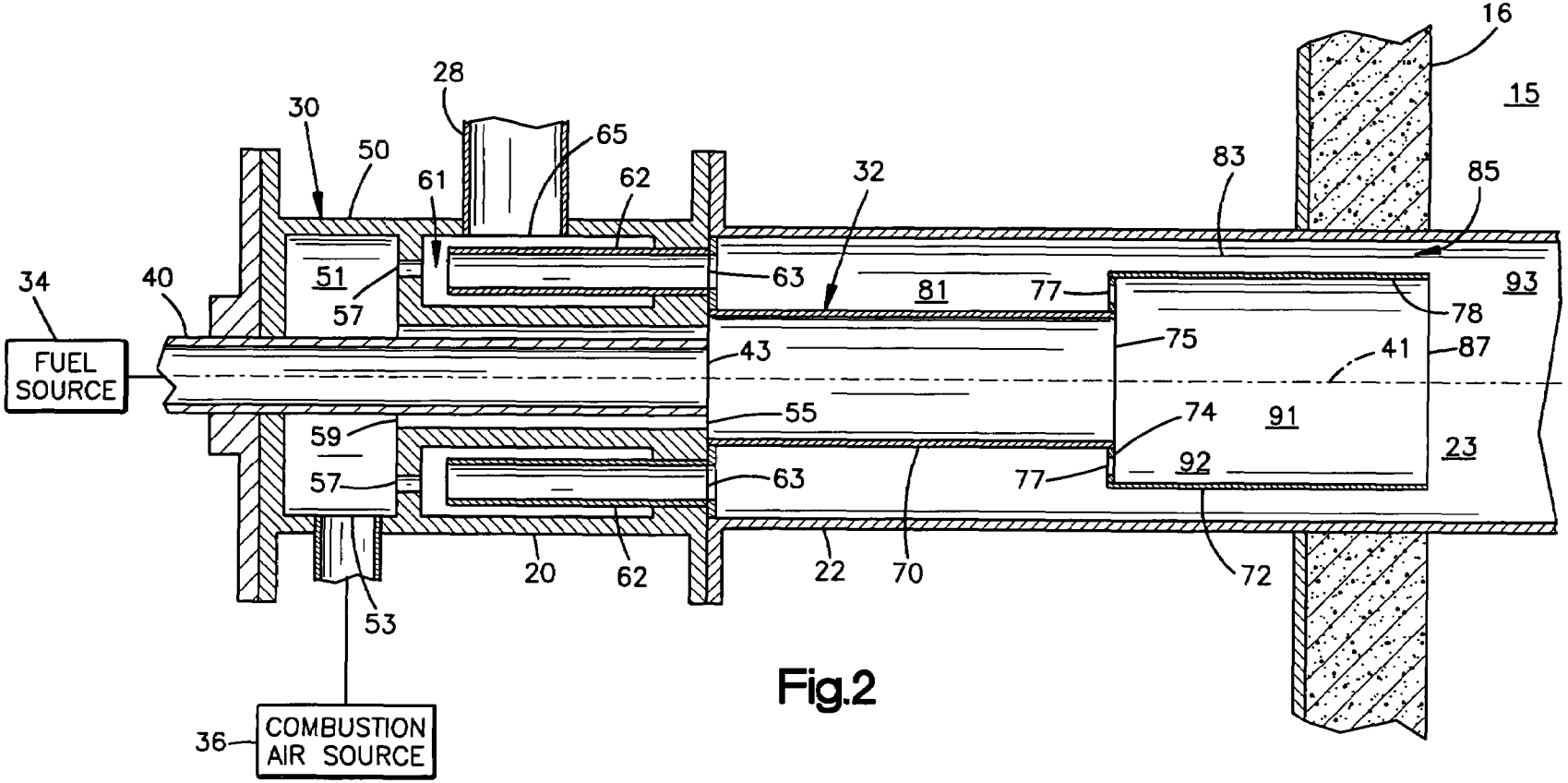
FIG. 2 is an enlarged sectional view of parts of the apparatus of FIG. 1.

As shown in FIG. 2, this example of the claimed burner assembly 20 has an outer portion 30 mounted on the outside of the radiant tube 10. It also has an inner portion 32 projecting from the outer portion 30 into the radiant tube 10. The outer portion 30 of the burner assembly 20 is configured to receive streams of fuel and combustion air from respective sources 34 and 36 (shown schematically), and to convey those reactant streams to the inner portion 32 of the burner assembly 20 at the inside of the radiant tube 10.

The outer portion 30 of the burner assembly 20 includes a fuel supply tube 40 which communicates with the fuel source 34. The fuel supply tube 40 has a longitudinal central axis 41, and delivers the fuel, which is preferably natural gas, to the inner portion 30 of the burner assembly 20 at an open end 43 of the tube 40.

A housing 50 at the outer portion 30 of the burner assembly 20 has a plurality of interconnected passages and chambers, including a combustion air chamber 51. The combustion air source 36, which is preferably a blower, delivers combustion air through an inlet 53 in the housing 50. The combustion air chamber 51 conveys the combustion air downstream to a primary air opening 55, and also to a plurality of secondary air openings 57. An annular section 59 of the combustion air chamber 51 surrounds the fuel supply tube 40. The primary air opening 55 is located at the end of the annular section 59 of the combustion air chamber 51, and faces into the radiant tube 10.

Each secondary air opening 57 leads from the combustion air chamber 51 to an inner chamber 61 that contains a plurality of secondary air tubes 62. The secondary air tubes 62 are arranged in a circular array centered on the axis 41, and have outer ends 63 facing into the radiant tube 10 at locations radially outward of the primary air opening 55.

As further shown in FIG. 2, the flue gas recirculation pipe 28 communicates with the inner chamber 61 through another inlet 65 in the housing 50. This provides a jet pump that recirculates flue gasses from the flue end portion 24 (FIG. 1) of the radiant tube 10 by drawing a stream of flue gases from the recirculation pipe 28 into the inner chamber 61, and further into the streams of combustion air that flow into the burner end portion 22 of the radiant tube 10 through the secondary air tubes 62. The streams of secondary air, along with the entrained flue gas, flow through the housing 50 in parallel with the stream of primary air so that the primary air is free of recirculated flue gas. In the example shown in FIG.

2, parallel flow paths are provided by placing the inlet 65 for the flue gas at a location downstream of the combustion air chamber 51.

The inner portion 32 of the burner assembly 20 includes a primary reactant tube 70 and a baffle 72. The primary reactant tube 70 is centered on the axis 41, and is located radially between the primary air opening 55 and the secondary air tubes 62. The baffle 72 is a can-shaped structure with an annular end wall 74 extending radially outward from the open inner end 75 of the primary reactant tube 70. A plurality of openings 77 extend through the end wall 74 in a circular array centered on the axis 41. The baffle 72 further has a cylindrical body wall 78 extending axially from the end wall 74 at a location radially between the primary reactant tube 70 and the surrounding radiant tube 10. In this configuration, the primary reactant tube 70 defines an annular space 81 radially between the primary reactant tube 70 and the radiant tube 10. The annular space 81 is a mixing chamber for flue gas recirculation. A narrower annular space 83 is defined radially between the cylindrical body wall 78 and the radiant tube 10. The narrower annular space 83 has an open end 85 surrounding the open end 87 of the cylindrical body wall 78.

In operation, the outer portion 30 of the burner assembly 20 directs streams of fuel and primary combustion air into the primary reactant tube 70 through the openings 43 and 55. The streams of fuel and primary combustion air mix together to form a primary reactant stream that emerges from the open end 75 of the primary reactant tube 70 as a combustible mixture for a first stage of combustion. The baffle 72 then functions as a stabilizer for a flame that projects axially toward and through the open end 87 of the cylindrical wall 78. Accordingly, the open end 75 of the primary reactant tube 70 is a first stage reactant inlet at the upstream end of a first stage region 91 of the combustion zone 23.

The secondary combustion air, which flows from the combustion air chamber 51 to the inner chamber 61 through the secondary air openings 57, mixes with the entrained flue gases upon flowing through the secondary air tubes 62 and further through the mixing chamber 81 toward the baffle 72. The gas flow openings 77 in the end wall 74 direct streams of that mixture into the baffle 72 at locations radially outward of the open end 75 of the primary reactant tube 70. The remainder of that mixture is conveyed further downstream from the mixing chamber 81 through the narrower annular space 83 to emerge from the annular opening 85. The openings 77 and 85 thus serve as second and third stage reactant inlets at upstream ends of respective second and third stage regions 92 and 93 of the combustion zone 23. As a result, the production of NOx is suppressed because staging the combustion air provides a lower peak flame temperature. The production of NOx is further suppressed because mixing the combustion air with recirculated flue gas reduces the percentage of oxygen that is available at the peak flame temperature. However, flue gas is not mixed with the combustion air in the first stage. Instead, it is mixed with the combustion air only in stages other than the first stage. This avoids flame instability that could otherwise occur if flue gas were mixed with the combustion air in the first stage.

This written description sets forth the best mode of the claimed invention, and describes the claimed invention to enable a person of ordinary skill in the art to make and use it, by presenting examples of the elements recited in the claims. The patentable scope of the invention is defined by the claims, and may include other examples that occur to those skilled in the art. Such other examples, which may be available either before or after the application filing date, are intended to be within the scope of the claims if they have elements that do not differ from the literal language of the claims, or if they include equivalent elements with insubstantial differences from the literal language of the claims.

The invention claimed is:

1. An apparatus for use with a radiant tube in which combustion proceeds downstream through a combustion zone extending along the length of the tube, the apparatus comprising:

a staging structure configured to direct reactants into the combustion zone in stages;

the staging structure including a primary reactant tube having an open end configured as a first stage reactant inlet to the combustion zone, with the primary reactant tube configured to extend within the radiant tube to define an annular mixing chamber radially between the primary reactant tube and the radiant tube;

the staging structure further including a baffle configured to be interposed between the mixing chamber and the combustion zone, with the baffle defining a second stage reactant inlet communicating the mixing chamber with the combustion zone, and defining a third stage reactant inlet communicating the mixing chamber with the combustion zone at a location downstream of the second stage reactant inlet.

2. An apparatus as defined in claim 1 wherein the baffle comprises a can-shaped structure having an annular end wall mounted on the primary reactant tube and a cylindrical body wall extending downstream from the annular end wall.

3. An apparatus as defined in claim 2 wherein the second stage reactant inlet is a gas flow opening through the annular end wall, and the third stage reactant inlet is a gas flow opening radially between the cylindrical body wall and the radiant tube.

4. An apparatus as defined in claim 1 wherein the staging structure further includes a jet pump configured to communicate a flue end portion of the radiant tube with the mixing chamber.

5. A method of providing combustion in a radiant tube in which combustion proceeds downstream through a combustion zone extending toward a flue end of the radiant tube, the method comprising:

forming a first reactant stream which contains fuel and combustion air, and which is free of gas recirculated from the flue end of the radiant tube;

directing the first reactant stream into the combustion zone to provide a first combustion stage;

forming a second reactant stream which contains combustion air and gas recirculated from the flue end of the radiant tube;

separately directing the second reactant stream into the combustion zone to provide a second combustion stage;

forming a third reactant stream which contains combustion air and flue gas recirculated from the flue end of the radiant tube; and separately directing the third reactant stream into the combustion zone at a location downstream of the location at which the second reactant stream is directed into the combustion zone to provide a third combustion stage downstream of the second combustion stage;

wherein the combustion air is mixed with gas recirculated from the flue end of the radiant tube in a mixing chamber that is located within the radiant tube but outside the combustion zone, and wherein the second and third reactant streams are both drawn from the mixing chamber.

6. An apparatus for use with a stream of fuel, a stream of combustion air, a stream of recirculated flue gas, and a radiant tube in which combustion proceeds downstream through a combustion zone extending along the length of the tube, the apparatus comprising:

a staging structure configured to extend within the radiant tube to define first, second and third stage reactant inlets at upstream ends of respective first, second and third stage regions of the combustion zone within the radiant tube;

a staging structure configured to extend within the radiant tube to define first, second and third stage reactant inlets at upstream ends of respective first, second and third stage regions of the combustion zone within the radiant tube;

said staging structure being further configured to communicate the first reactant inlet with the streams of fuel and combustion air to the exclusion of the stream of recirculated flue gas, and to communicate the second and third reactant inlets with the streams of combustion air and recirculated flue gas to the exclusion of the stream of fuel;

wherein the third reactant inlet is located downstream of the second reactant inlet; and wherein the staging structure is configured to define a mixing chamber inside the radiant tube but outside the combustion zone, and to communicate the mixing chamber with the streams of combustion air and recirculated flue gas to the exclusion of the stream of fuel, and wherein the second and third reactant inlets communicate the mixing chamber with the second and third stage regions of the combustion zone, respectively.

* * * * *